US010232662B2

(12) United States Patent
Swaminadhan

(10) Patent No.: US 10,232,662 B2
(45) Date of Patent: Mar. 19, 2019

(54) ANGLE-ADJUSTABLE, GRAVITY FLOW INK REFILL AND PEN

(71) Applicant: Vikram Aditya Swaminadhan, Montreal (CA)

(72) Inventor: Vikram Aditya Swaminadhan, Montreal (CA)

( * ) Notice: Subject to any disclaimer, the term of this patent is extended or adjusted under 35 U.S.C. 154(b) by 28 days.

(21) Appl. No.: 15/261,944

(22) Filed: Sep. 10, 2016

(65) Prior Publication Data

US 2017/0072735 A1 Mar. 16, 2017

Related U.S. Application Data

(60) Provisional application No. 62/217,080, filed on Sep. 11, 2015.

(51) Int. Cl.

| | |
|---|---|
| ***B43K 5/04*** | (2006.01) |
| ***B43K 17/00*** | (2006.01) |
| ***B43K 7/00*** | (2006.01) |
| ***B43K 8/02*** | (2006.01) |
| ***B43K 8/20*** | (2006.01) |
| ***B43K 8/03*** | (2006.01) |

(52) U.S. Cl.

CPC ..... *B43K 5/04* (2013.01); *B43K 7/005* (2013.01); *B43K 8/024* (2013.01); *B43K 8/03* (2013.01); *B43K 8/20* (2013.01); *B43K 17/005* (2013.01)

(58) Field of Classification Search

CPC . B43K 5/04; B43K 7/005; B43K 8/03; B43K 8/20; B43K 17/005

See application file for complete search history.

(56) References Cited

U.S. PATENT DOCUMENTS

| | | | | | |
|---|---|---|---|---|---|
| 1,950,960 | A * | 3/1934 | Wisser | B43K 29/001 | 33/27.02 |
| 2,911,950 | A * | 11/1959 | Freeman | B43K 7/005 | 401/209 |
| 4,580,919 | A * | 4/1986 | Ambasz | B43K 7/005 | 401/117 |
| 5,527,124 | A * | 6/1996 | Kolaric | B43K 5/005 | 401/109 |
| 5,584,195 | A * | 12/1996 | Liu | A44C 5/0007 | 401/131 |
| 6,328,494 | B1 * | 12/2001 | Moxon | B43K 5/005 | 15/443 |
| 7,108,439 | B2 * | 9/2006 | Zhu | B43K 7/005 | 401/109 |

(Continued)

*Primary Examiner* — Ryan A Reis

(57) ABSTRACT

An angle-adjustable, gravity flow ink refill and pen, each comprising of at least one bendable portion along its length. The bendable portion acts as a concertina-type hinge to allow both the pen and refill to bend to an angle and maintain the bend imparted to it. In a preferred embodiment, the refill is flexible in structure (full or partial) and the pen having a crimped corrugated bendable portion. In an alternate embodiment, intertwined helical wires form the bendable portion for the pen, the refill or both to maintain the angle bent. Alternatively a flexible gooseneck tube is used for the bendable portion of the pen. The pen writes normally on flat surfaces and on inclined surfaces, the rear end of the pen is bent forward such that the rear is pointed upwards towards the sky. This allows ink to flow towards the tip via gravity and facilitate consistent delivery of ink at multiple writing angles.

19 Claims, 8 Drawing Sheets

(56) References Cited

U.S. PATENT DOCUMENTS

| | | | | |
|---|---|---|---|---|
| 2006/0088361 | A1* | 4/2006 | Nakhaie | B43K 5/005 401/6 |
| 2012/0055278 | A1* | 3/2012 | Hasty | B43K 7/005 74/89.45 |

* cited by examiner 15
17
13
12
14
21
12
16

ANGLE-ADJUSTABLE, GRAVITY FLOW INK REFILL AND PEN

FIELD OF THE INVENTION

The present invention relates generally to writing instruments but more particularly to a bendable, gravity flow ink refill and pen.

BACKGROUND OF THE INVENTION

Pens have evolved from ink dipped reeds and quills to modern day writing instruments made up of ball-point pens, fountain pens, roller-ball pens, felt-tip pens, stylus pens etc. They are used on a daily basis by people of varying ages around the world. With the advent of technology, people are increasingly writing on their mobile devices, computers and tablets. They do so while sitting, reclining and lying back. The medium they are using allows one to write on its surface at any angle. Writing downward is no longer a rule. Similarly, students, home makers, doctors, nurses, patients, handymen and many other individuals face the need to write while on the move, against a wall, while in bed, on a commuter train or bus, on the fridge or at work. Current pens stop writing when the pen is close to being horizontally inclined. The flow of ink stops due to gravitational reasons. There presently exist solutions such as pressurized and pump action refills which allow pens to write at multiple angles. These pens are made of multiple parts and cost a lot higher than an average disposable pen. Furthermore they are not of a disposable variety. A large proportion of pen users currently use affordable, disposable plastic pens which are easy to manufacture. There hence exists a need for an affordable, disposable pen and ink refill that can write at various angles.

SUMMARY OF THE INVENTION

In view of the foregoing disadvantages inherent in the known devices now present in the prior art, the present invention, which will be described subsequently in greater detail, is to provide objects and advantages which are:

To provide for an angle-adjustable pen and ink refill that can bend in any direction at one or more segments along its length and stay put at the angle it is bent to.

It is another advantage of this invention that the pen and refill contained within be bent at one bendable segment that is positioned between 3 cm and 7 cm up from the nib of the pen, approximately one-fourth the length of the pen above the writing tip, such that a user's fingers can grasp and write with the pen at one angle while the rest of the pen and refill above the bendable segment are angled upwards to the sky so as to allow effective flow of the ink to the nib via gravity.

It is further advantage of this invention that the ink refill permits uninterrupted flow of ink to the nib or writing tip when held at angles from 0° (zero degrees) where the tip is pointed downwards, (and perpendicular to a flat surface) up to an angle of 140° (one hundred and forty degrees) where the tip is pointed upwards and the rest of the body of the refill is also bent and pointed upwards toward the sky. This remains possible as long as the quantity of ink contained in the refill above the bendable segment is more than the quantity of the ink held below the flexible, bendable segment and the tip. This holds true assuming that the refill is of equal diameter along its entire length. In order to enhance ink delivery the top two third portion of the refill in one embodiment is of a larger diameter and the bottom, bendable one-third of the refill be of a smaller diameter. The volume of ink above the bendable segment would be greater thereby enhancing ink delivery and writing performance when the pen is writing at angles of 90 degrees and above.

In order to do so, the invention comprises a bendable, gravity flow writing tool which has a body, and an ink refill contained therein. The body has an open tip end, and a resiliently bendable section configured so as to maintain any given bend imparted to it. The ink refill is generally cylindrically elongated, and has a nib at one end, and a flexible, resiliently bendable segment located above the nib and aligned with the bendable section of the body.

In one embodiment, the ink refill is inserted inside a casing which has a nib opening for passing the ink refill nib, and an opening at its opposite end to insert the ink refill. Once in the casing, the ink refill is capable of resiliently bending while being able to maintain a bend imparted to it. The ink refill, ink cartridge or reservoir is made of an elongated cylinder of plastic, metal or choice of material having a nib at one end and a flexible, bendable segment of between 2 cm to 5 cm in length made up of crimped ridges and grooves situated approximately three to seven centimeters above the tip, nib or point and the pen casing having a similar bendable segment aligned with that of the refill. Alternatively, the refill is flexible in nature and the pen casing bends and stays put at a desired angle. Another embodiment consists of a flexible refill housed within a more rigid refill casing having at least one bendable segment where it is able to bend in order to deliver the ink while writing at various angles. The flexible refill in yet another embodiment is wrapped in an intertwining helical pattern of two or more metal wires allowing the refill to bend and stay put at the angle to which it is bent. The nib of the refill can be comprised of a ball point tip, fountain pen nib, roller-ball, felt-tip etc. The length of the corrugated or crimped segment of the refill can be varied depending on the material used and the bending ability of the pen. The refill cylinder continues beyond the corrugated segment till the top end of the refill which is left open or partially closed (if required). The refill is inserted into a pen made of one piece similar to the refill or made up of two, three or more segments depending on the design and manufacturing mandate. In a single piece embodiment, the pen is a cylinder with a tapering tip and a hole through which the refill is inserted and closed with a tapered cap having a circular hole for the refill tip. Alternatively the refill is inserted through the back end and is closed with a button cap. The pen housing in its basic form is a cylinder made of polypropylene or similar material which is crimped into bendable bellows at a segment along its body between 3 cm and 7 cm from the pen nib, allowing the pen body to be bent at an angle in any direction and maintain any angle imparted to it. The length of the bendable segment will correspond approximately to the length of the bendable segment on the refill but will also be determined based on the density of the material used and weight of the pen. Accordingly the number, thickness and height of ridges and grooves will vary.

In an alternate embodiment, the bendable segment is a flexible bellow structure or flexible tubing and the pen is held in various positions via the refill having intertwined helical metal wires as described above. Alternatively, the pen casing has a bendable segment comprised of intertwined helical metal wires and the refill is flexible.

In yet another embodiment having two, three or more stages or segments, the pen may comprise of a head or tapering section followed by a bendable section. This section is connected to the barrel section which is then connected to a push button or screw type head with pen clip similar to many other pens. Coupling rings may be provided between segments. The bendable segment in this embodiment can be in the form of a flexible gooseneck tubing which allows the pen to bend, support, and stay put in a selected position until it is repositioned again. The number of sections can be alternated based on manufacturing and design sentiment. The ink cartridge, refill or reservoir contained within is as per the various embodiments described above.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiment of the invention.

DETAILED DESCRIPTION

Figures 1A, 1B, 1C:
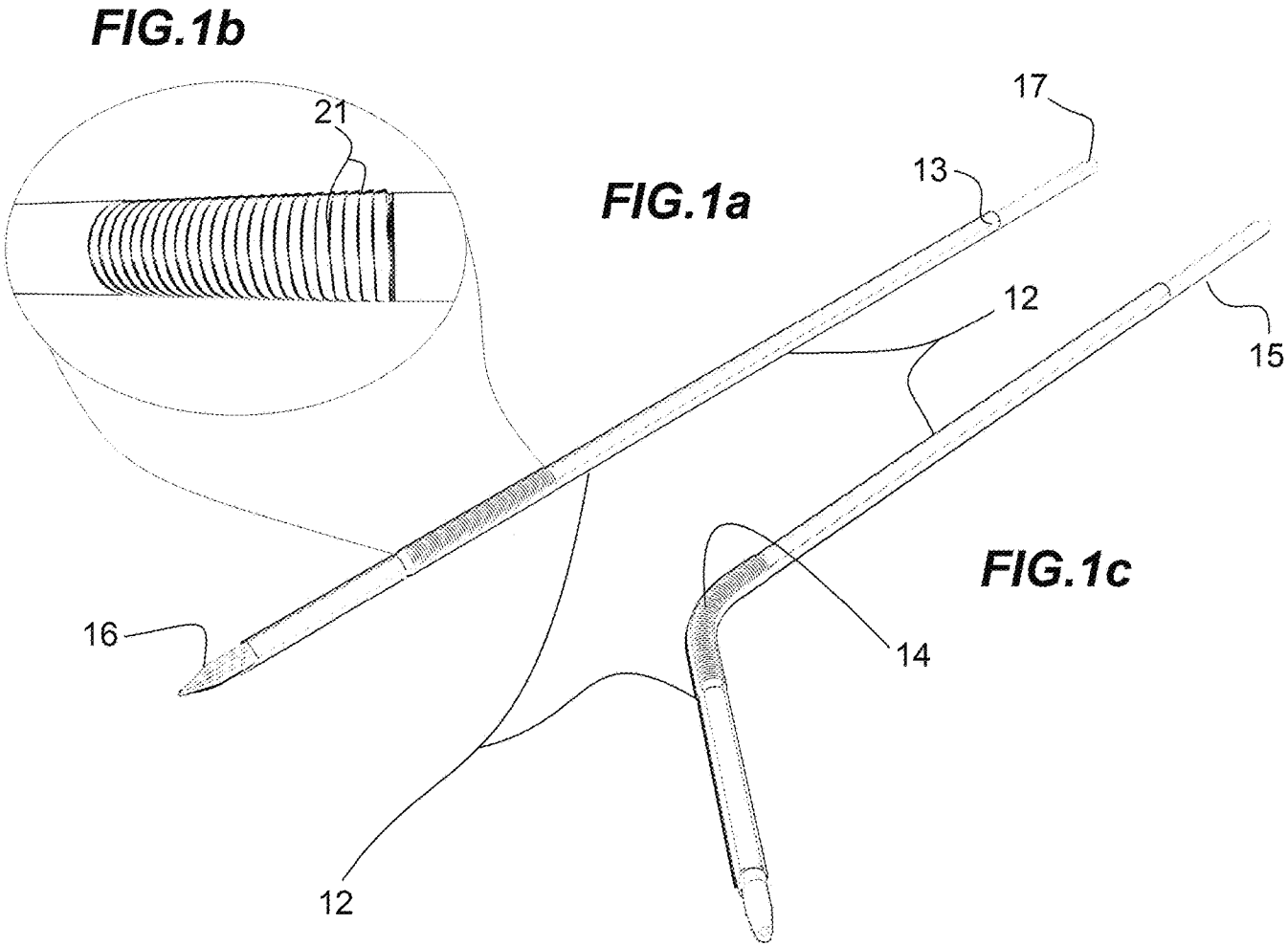
FIGS. 1*a-b-c* Isometric view of a refill with a single bendable segment in a straight position, zoom view of bendable segment of the refill and isometric view of the bendable refill in an angular position FIGS. 2*a-b* Isometric view of the bendable refill and pen in a straight position and isometric view of the bendable refill and pen in a bent position FIGS. 3*a-b-c* Zoom view of flexible gooseneck bendable section, isometric view of pen in an alternate embodiment and side view of pen in an alternate embodiment in an upright writing position with top portion bent forward at an angle FIG. 4 Isometric view of the pen in use on a writing surface that is 90 degrees to the earth's horizontal plane FIG. 5 Side view of an alternate embodiment of the refill having a narrow diameter flexible delivery spout and a wider diameter rigid barrel FIG. 6 Isometric view of an ink fountain pen with bendable segment FIG. 7 Top view of a flexible refill embodiment FIGS. 8*a-b-c* Isometric view of a flexible corrugated hose, isometric view of pen with bendable segment comprising intertwined helical wires and side view of a flexible refill encased in intertwined helical wires
Figures 2A, 2B:
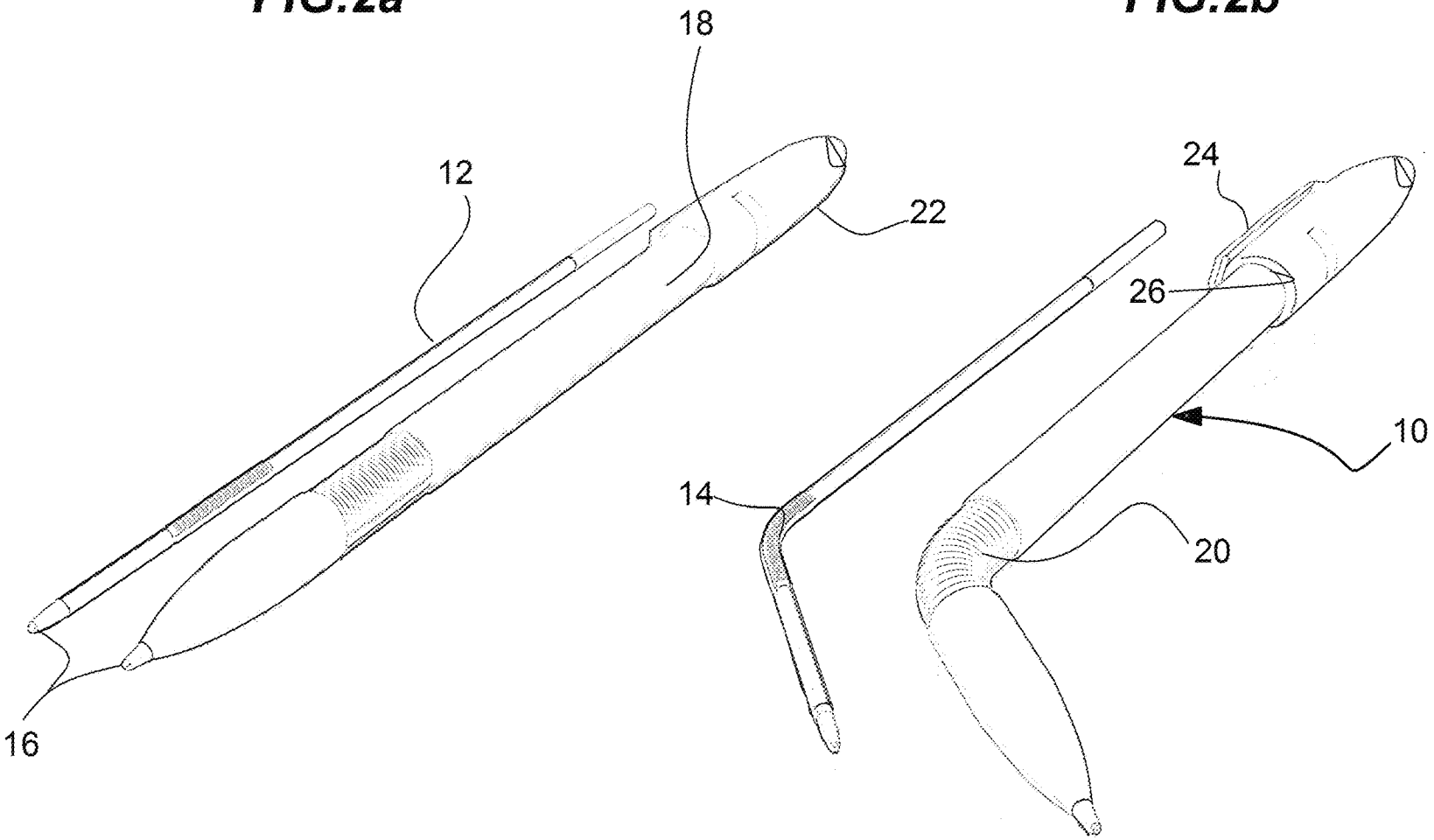
Figure 5:
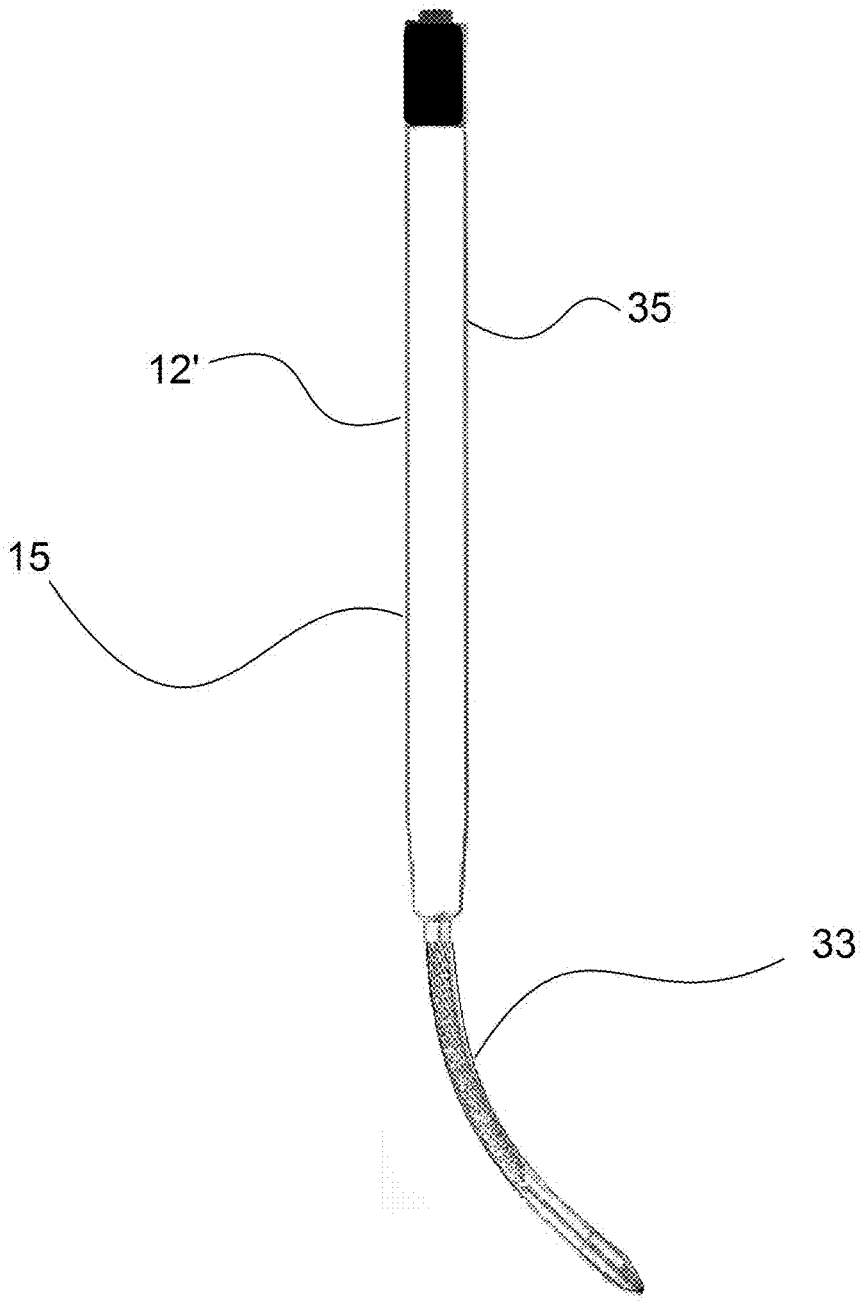
Figure 7:
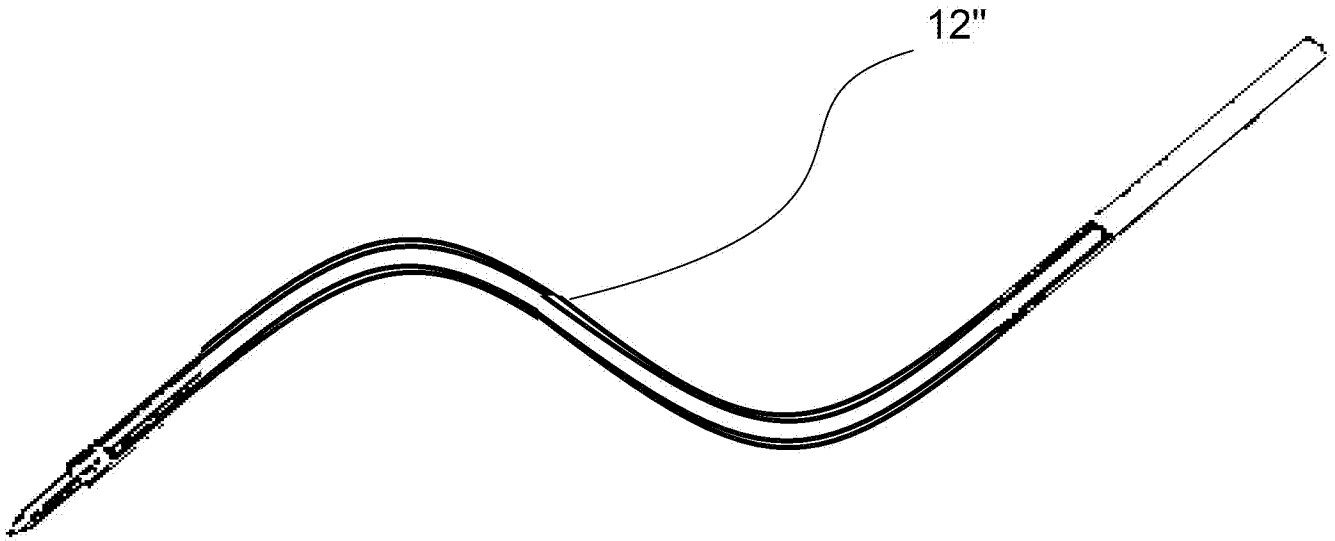
Figure 8A:
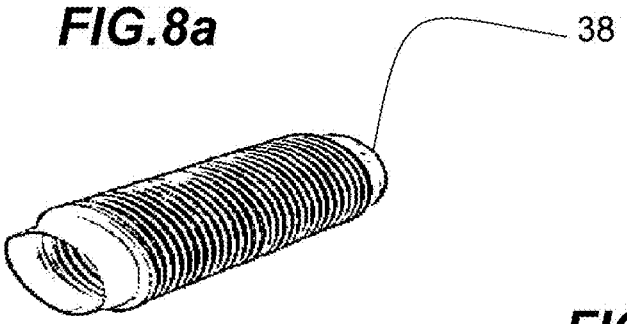
Figure 8B:
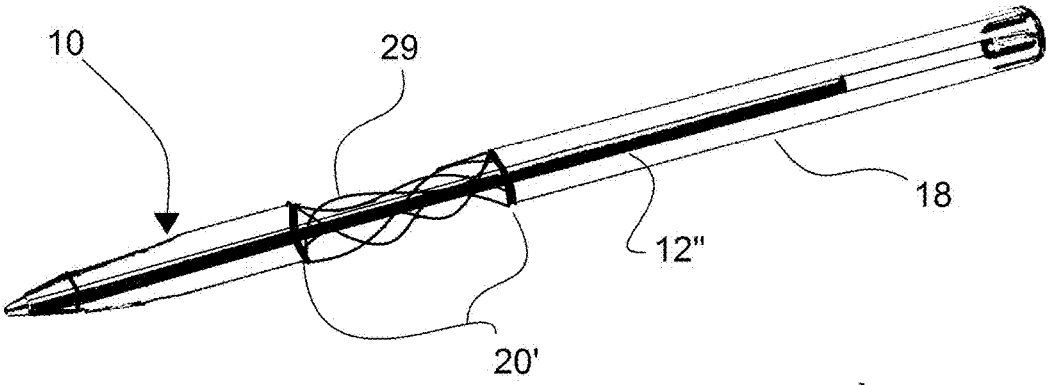
Figure 8C:
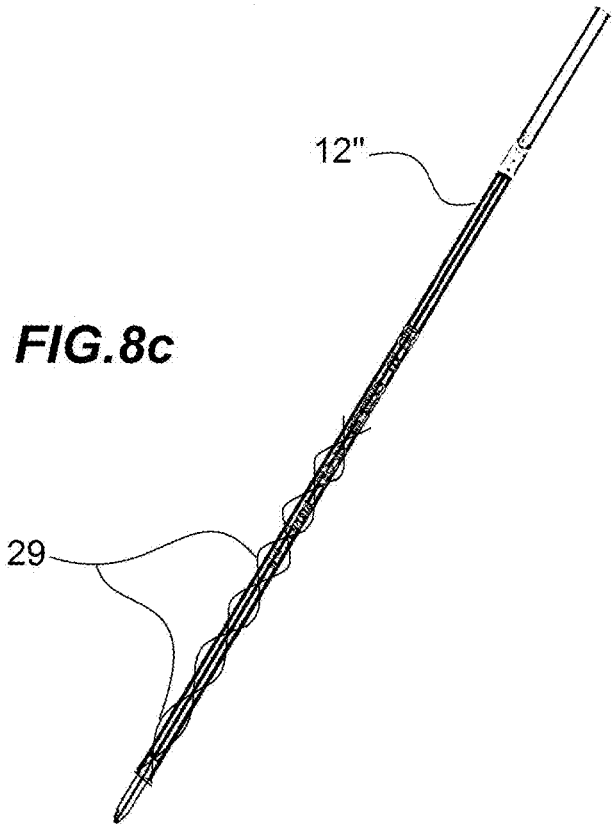

An angle-adjustable, gravity flow refill and pen (10) having bendable corrugated portions (14) and (20) respectively. The ink refill (12) containing an ink fluid or gel (13) within is composed of a long cylindrical casing (15) with a writing nib (16) at one end, a bendable corrugated portion (14) positioned nearer the nib (16) and an open or partially open end (17) in one embodiment. In an alternate embodiment (see FIG. 5), an ink refill (12') having a flexible delivery spout (33) with a narrow diameter and a more rigid main body (35) having a wider diameter. In yet another embodiment (see FIG. 7), an ink refill (12") that is flexible in structure and is able to bend at any point along its length. In a further embodiment (see FIG. 8*c*), a flexible ink refill (12") encased in intertwined helical wires (29) allowing the ink refill (12") to bend and maintain any given bend applied to it. The bendable corrugated portions (14) and (20) comprise of multiple parallel folds (21) that form ridges (not shown) and grooves (not shown) allowing the corrugated portions (14) and (20) to bend much the same as a concertina-type hinge (not shown). The invention (10) (FIGS. 2*a* and 2*b*) in a preferred embodiment has a pen cap (22) having a clip (24) and an opening (26) at one end.

The invention (10), in a preferred embodiment comprises of a hollow cylindrical casing (18) having a crimped bendable corrugated portion (20) and closed at the rear end (31) with a cap (not shown) after the ink refill (12, 12' or 12") is inserted into the hollow cylindrical casing (18).

Figures 3A, 3B, 3C:
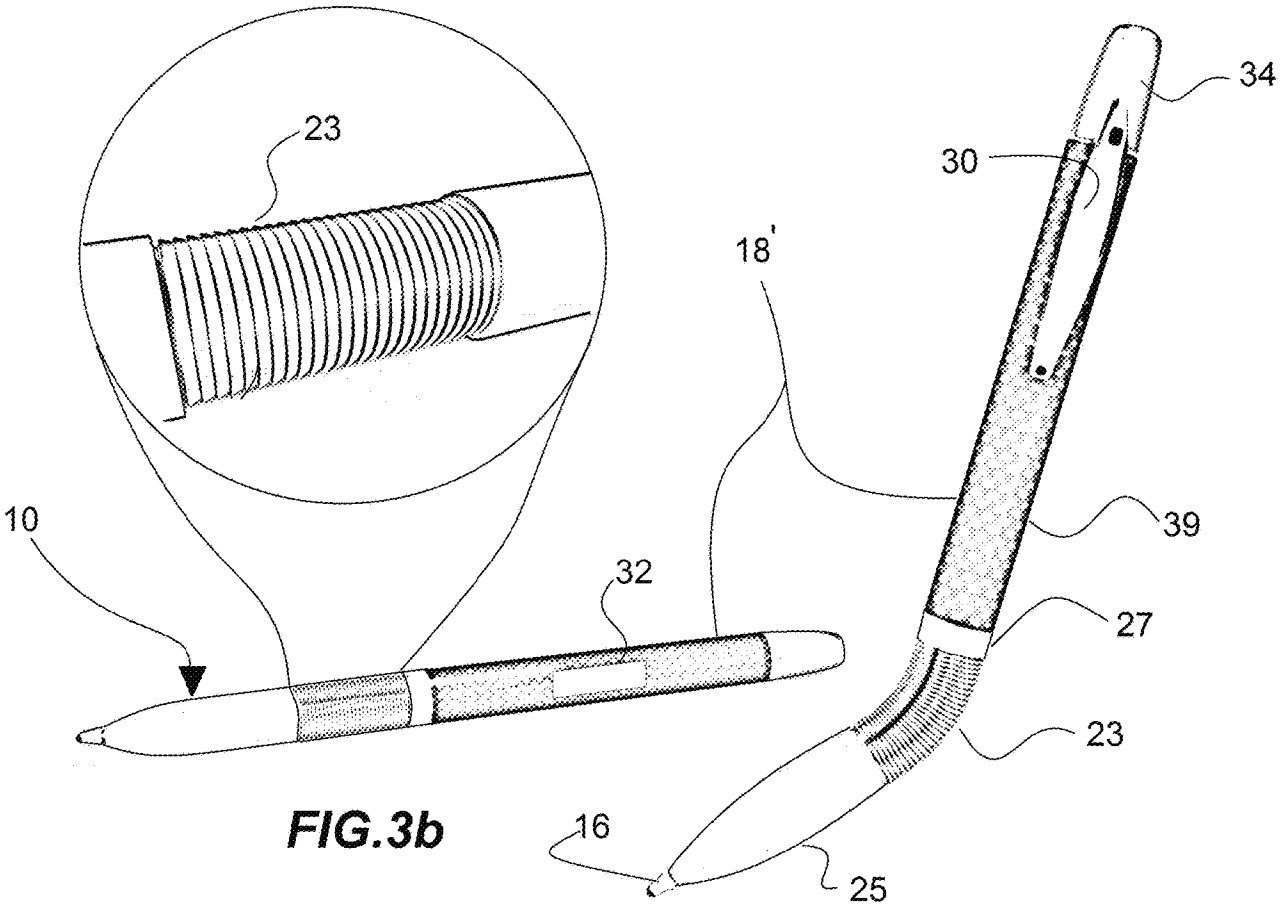

Alternatively, the invention (10) in an alternate embodiment (see FIG. 8*b*) comprises of a bendable segment (20') on the hollow cylindrical casing (18) composed of intertwined helical wires (29) that bend and maintain a given bend and having a flexible refill (12") contained within the cylindrical casing (18). The bendable segment (20') comprising intertwined helical wires (29) is encased in a flexible corrugated hose (38). In yet another alternate embodiment of the invention (10) (See FIGS. 3*b* and 3*c*), the cylindrical casing (18') is comprised of a main barrel (39) attached to a bendable gooseneck segment (23) at one end which in turn is attached to a tapered head segment (25). The main barrel (39) is attached at the other end to a screw-type head (34) having a clip (30) provided on it. The cylindrical casing (18') can also comprise of one or more coupling rings (27) and a logo (32) embossed, engraved or imprinted on it. Ink refills (12, 12' or 12") may be contained within the cylindrical casing (18').

Figure 6:
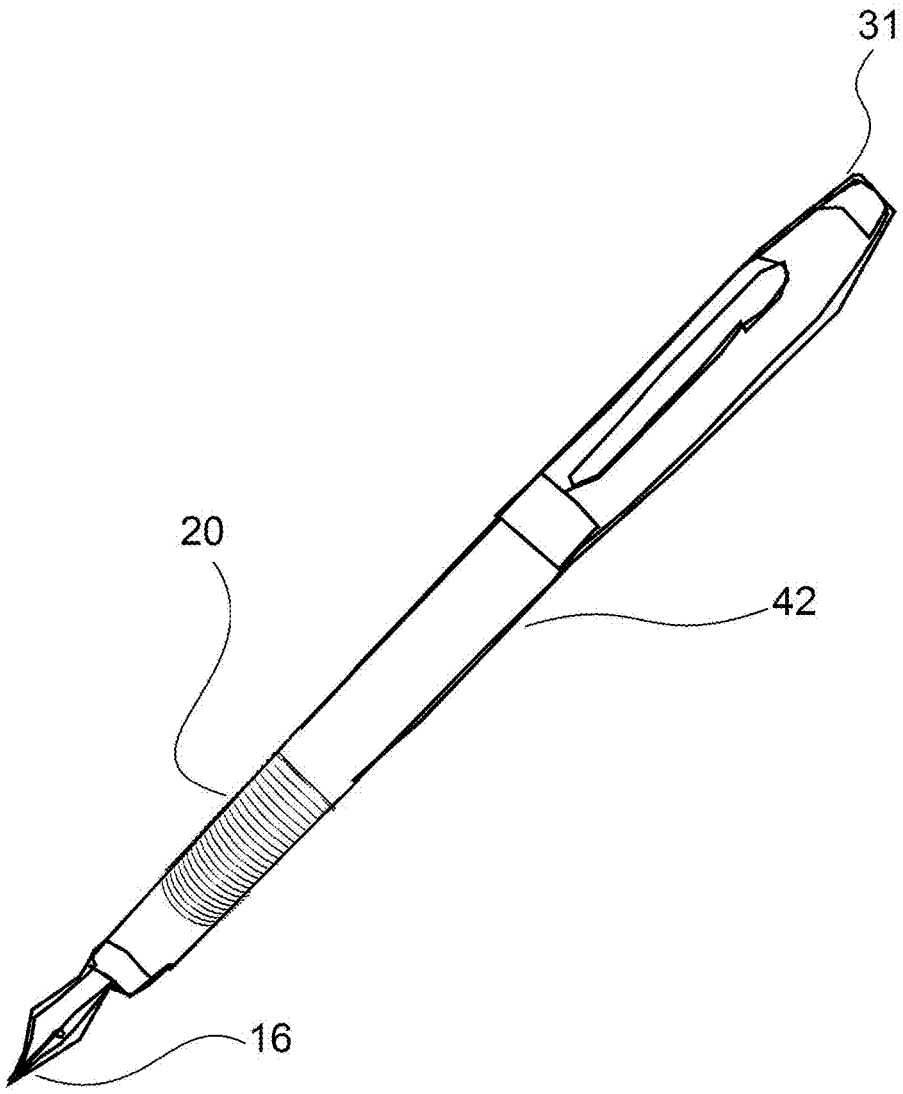

The invention (10) can also exist as a fountain pen (42) embodiment (see FIG. 6) where the ink chamber (not shown) is in the form of a sealed receptacle or pouch (not shown) contained within the pen (42).

Figure 4:
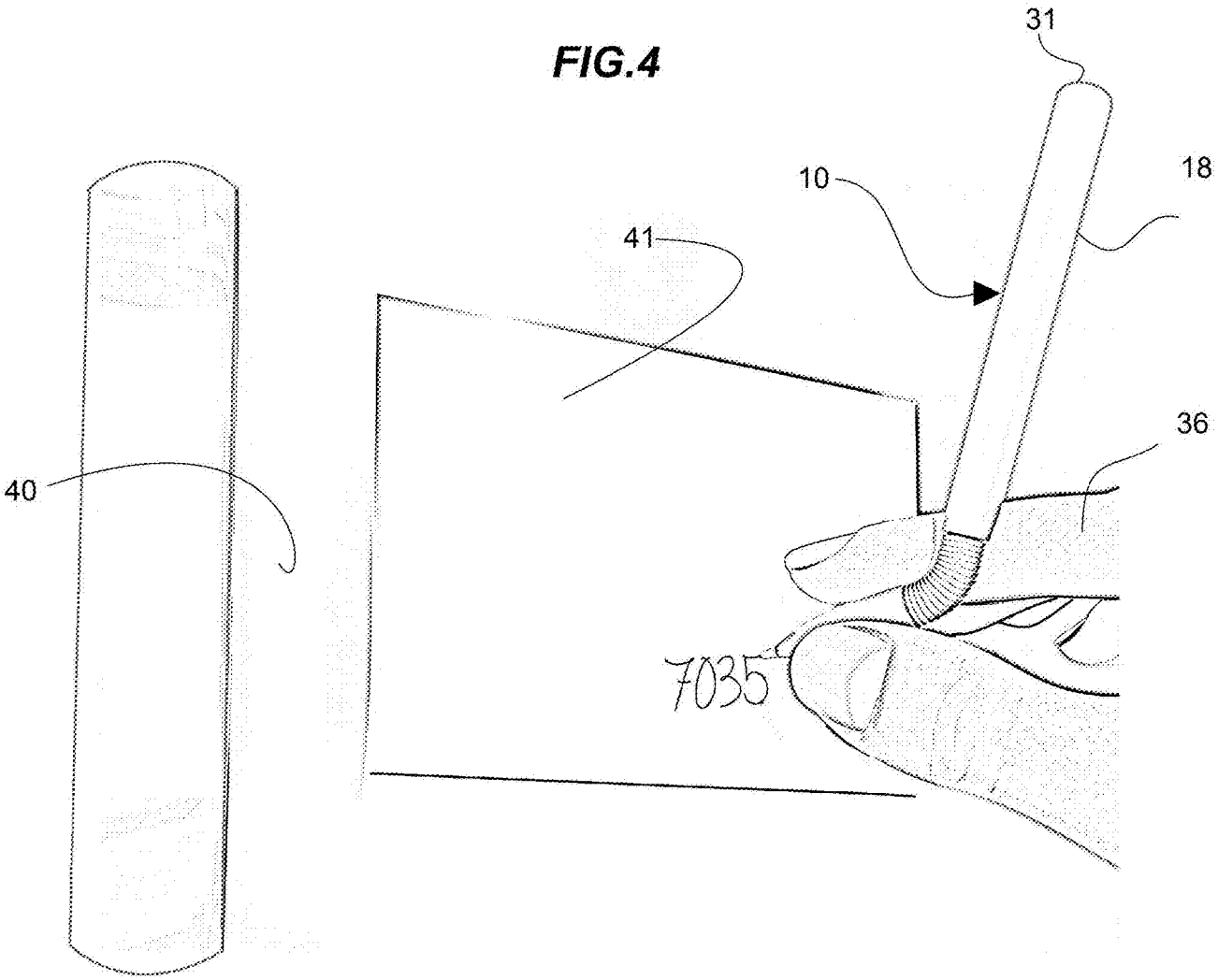

The bendable refills (12, 12', 12"), inside cylindrical casings (18, 18') and the ink pen (42) can be used much the same as any normal pen (not shown) when writing on a flat surface (not shown). When a user (36) wishes to use the invention (10) on an inclined writing surface (41) such as against a refrigerator (40) (see FIG. 4), the bendable segments (20, 20') or the bendable gooseneck portion (23) of the invention (10) is bent forward such that the rear end (31) of the invention (10) points upwards allowing gravity to push the flow of ink (13) contained within the refills (12, 12', 12") or fountain pen (42) towards the nib (16) for an uninterrupted writing experience.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A bendable, gravity flow writing tool, capable of writing at multiple angles, having a body and an ink refill contained therein; said body having an open tip end and a bendable section configured so as to maintain any given bend imparted to it; said bendable section of said body comprised of a concertina-type hinge including a plurality of pleats which allow said section to maintain a given bend until a manual or external force is applied to it to rebend and readjust the angle of the bend; said ink refill being generally elongated, and having a nib at one end, and a flexible, bendable segment located above said nib and aligned with said bendable section of said body; said ink refill and said body allowing uninterrupted flow of ink to its nib when held at any angles between 0° wherein the tip is pointed downwards and 140° wherein said nib is pointed upwards while said writing tool parts starting from a bendable segment part onward is pointing upwards; said uninterrupted flow when nib is pointed upwards being possible until a quantity of ink contained in said ink refill rearward of said bendable segment is equal or less than the quantity of ink held forward of said bendable segment.

2. The bendable, gravity flow writing tool as in claim 1 wherein said body consists of a cylinder having a tapering open tip at one end, and an opening at its opposite end through which an ink refill is inserted inside said body.

3. The bendable, gravity flow writing tool as in claim 1 wherein said bendable section of said body consists of a stay put tubing.

4. The bendable, gravity flow writing tool as in claim 1 wherein said bendable section of said body consists of a flexible bellow structure wherein said body held in position by way of said ink refill, and wherein said ink refill having intertwined helical metal wires such that the intertwined helical wires allow said body to be bent, adjusted and held at varying angles until manually readjusted.

5. The bendable, gravity flow writing tool as in claim 1 wherein said ink refill is comprised of a concertina-type hinge section aligned with said bendable section of said body and including a plurality of pleats capable of bending and being able to maintain a given bend imparted to it.

6. The bendable, gravity flow writing tool as in claim 1 wherein said ink refill being wrapped in an intertwining helical pattern of at least two metal wires allowing said ink refill to bend and able to maintain a bend imparted to it.

7. The bendable, gravity flow writing tool as in claim 1 wherein said ink refill being flexible along its length and said bendable section of body comprising an intertwining helical pattern of at least two metal wires allowing said body to bend and able to maintain a bend imparted to it.

8. The bendable, gravity flow writing tool as in claim 1 wherein said nib type is selected from the group comprised of ball point tip, fountain pen, roller-ball, micro tip, gel tip and felt tip.

9. The bendable, gravity flow writing tool as in claim 1 wherein said bendable ink refill consists of crimped ridges and grooves.

10. The bendable, gravity flow writing tool as in claim 5 wherein said bendable casing consists of crimped ridges and grooves.

11. The bendable, gravity flow writing tool as in claim 1 wherein said body being made of flexible plastic, metal, rubber or polypropylene.

12. The bendable, gravity flow writing tool as in claim 1 wherein said body has its bendable section being approximately 2 cm to 5 cm in length and located between 3 and 7 cm above said nib.

13. The bendable, gravity flow writing tool as in claim 1 wherein said refill has its bendable section being approximately 2 cm to 5 cm in length and located between 3 and 7 cm above said nib.

14. The bendable, gravity flow writing tool as in claim 5 wherein said body has its bendable section being approximately 2 cm to 5 cm in length and located between 3 cm and 7 cm above said open tip end.

15. The bendable, gravity flow writing tool as in claim 1 wherein said body having multiple segments that are bendable so as to provide a plurality of shapes.

16. The bendable, gravity flow writing tool as in claim 1 wherein bendable section of said body comprises of a stay-put gooseneck tube.

17. The bendable, gravity flow writing tool as in claim 16 wherein said ink refill being flexible along its length.

18. The bendable, gravity flow writing tool as in claim 16 wherein said ink refill is comprised of a concertina-type hinge section aligned with said bendable section of said body and including a plurality of pleats capable of bending and being able to maintain a given bend imparted to it.

19. The bendable, gravity flow writing tool as in claim 16 wherein said ink refill being wrapped in an intertwining helical pattern of at least two metal wires allowing said ink refill to bend and able to maintain a bend imparted to it.

* * * * *